United States Patent [19]

Pate

[11] Patent Number: 5,000,655

[45] Date of Patent: Mar. 19, 1991

[54] INSTALLATION FOR MANUFACTURE OF CERAMIC PRODUCTS

[76] Inventor: Andre Pate, 21340 Nolay, Nolay, France

[21] Appl. No.: 268,642

[22] Filed: Nov. 7, 1988

Related U.S. Application Data

[63] Continuation of Ser. No. 890,633, Jul. 25, 1986, abandoned.

[30] Foreign Application Priority Data

Jul. 26, 1985 [FR] France ..... 85 11455

[51] Int. Cl.[5] ..... F27B 9/26; F27D 3/12

[52] U.S. Cl. ..... 414/788.8; 198/463.4; 414/154; 414/791

[58] Field of Search ..... 414/154, 157, 222, 789.5, 414/791, 788.8, 796, 150, 152, 196, 211; 425/404, DIG. 108, DIG. 118, DIG. 201; 198/463.4, 463.6

[56] References Cited

U.S. PATENT DOCUMENTS

| | | | |
|---|---|---|---|
| 2,423,557 | 7/1947 | Gray | 414/154 X |
| 3,384,939 | 5/1968 | Baker | 425/404 X |
| 3,604,554 | 9/1971 | Martz | 198/463.6 X |
| 4,403,931 | 9/1983 | Cuman et al. | 425/404 X |
| 4,661,325 | 4/1987 | Noro et al. | 414/157 X |

FOREIGN PATENT DOCUMENTS

| | | | |
|---|---|---|---|
| 31598 | 10/1961 | Finland | 414/157 |
| 2404821 | 4/1979 | France . | |
| 2480253 | 4/1986 | France . | |
| 2584805 | 1/1987 | France . | |

*Primary Examiner*—Robert J. Spar
*Assistant Examiner*—Janice Krizek
*Attorney, Agent, or Firm*—Darby & Darby

[57] ABSTRACT

Installation for handling ceramic products comprising a closed circuit 1 of carriages 2 passing through furnaces for drying 3 and baking, an unstacking station 7 and a stacking station 6 combined with transverse endless belts, one, 10, running from an empty support loading 13 to a stacking station 6 with operations of loading of green products on the supports, the other, 11, running from a station for picking up baked products 7 to a packaging station 29, the other, 12, running from the pickup of empty supports 7 to a system 30 of storage and transfer which returns the empty supports to the first belt 10; a first battery of pincers 21 operates between belt 10 and the position for stacking on carriages intermediate stops at the unstacking station 43; equidistant retractable mobile stops 17, 19 which are linked together, bringing the supports closer together for stacking and batteries of stops 36, 37 separating them for storage, transfer and loading on a belt.

17 Claims, 3 Drawing Sheets

INSTALLATION FOR MANUFACTURE OF CERAMIC PRODUCTS

This is a continuation, of application Ser. No. 890,633, filed 7/25/86, now abandoned.

The automatic handling of ceramic products always presents delicate problems. As a matter of fact, when the products are raw and green, the risk of misshaping is considerable and they must be handled by means of supports on which they are placed with care, while once they are dry or baked, it is generally best to group them in packs: the risks then result from their fragility.

But in certain modern installations, such as the one described in French Pat. No. 2,584,805, published Jan. 16, 1987, in the name of the Societe d'Etudes et de Constructions Electriques et Mechaniques SECEM, the products are exposed to drying and baking on the same supports which are ceramic or refractory supports on which the products are without contact between each other, supports which can be stacked without contact with the products on adjoining supports. In this case a transfer handling between the drying furnace and the baking furnace is unnecessary. But it becomes possible, if not necessary, to design a handling installation that operates both on the supports and on the products themselves in a total cycle providing the placement of the raw and green products on the supports, the stacking, strictly in position, of the supports on the carriages, the unstacking of the supports and the pickup of the baked products, the return of the supports and the packaging of the baked products.

The object of the present invention is an installation embodying these objectives. It relates to an installation for handling ceramic products of the type incorporating: a closed-circuit track or route for carriages, passing through a drying furnace and/or a baking furnace, crossing a zone comprising a station for picking up baked products and unstacking their supports, followed by a station for stacking supports loaded with raw or green products, characterized in that it incorporates:

a—A first conveyor or endless chain running transversely to the said track on which are placed empty supports that are then loaded with raw products as they pass in front of a loading station and terminate at the end of the said conveyor at a station for stacking the loaded supports on a carriage on the track, b—A second conveyor or endless chain, likewise transversal, running in the opposite direction to the first, from a station where baked products are picked up on the supports, to a station where these baked products are collected for packaging, c—A third conveyor or endless chain placed beside the second, running from the station where the empty supports are unstacked to a conveyor transferring the said supports, d—A first set of grasping means designed for the raw products, with vertical movements, and displaceable parallel to the track between a position situated above the first conveyor and a position above a carriage placed on the track in stacking position, e—A second set of grasping means designed for baked products, likewise with vertical movements and displaceable parallel to the track between the second and third conveyors, f—Stepwise drive means for the various conveyors linked with the operations of loading the supports, loading the raw products, stacking the supports loaded with raw products, picking up baked products, unstacking empty supports, and storage and/or transfer.

The installation operates as follows:

With a carriage at the stacking station, a series of supports is brought by the first belt before the press which loads them with raw and green products; the same belt carries them over the carriage track to the stacking station, where the supports are moved close together and placed side by side in a strictly controlled position; the first battery of pincers takes the series of supports loaded with products and deposits them on the stack being formed; when a stack is complete, the carriage moves from the gap between two consecutive stacks.

With another carriage, simultaneously or not, being at the unstacking station, the second battery of pincers goes into action and on the one hand picks up a series of baked products to deposit them on the second endless belt which brings them to the station for pickup for packaging, and on the other hand, a series of empty supports, to deposit them on the third endless belt which brings them to the storage station and to the empty support transfer system; in the course of the latter displacements the supports are separated from one another and positioned in the original spacing; with a view to the loading of the green and raw products on the supports.

The invention also envisages the following preferential dispositions:

(1) The strict positioning of the supports is embodied by means of mobile and retractable stops under the endless belt, these stops cooperating with the internal faces of lateral bottom flanges borne by the said supports so as to cause the latter to stop while the belt or chain continues to advance, thus sliding under the supports blocked by the stops.

(2) The initial spacing between supports at the loading station on the first belt is several centimeters, while this spacing is reduced to a few millimeters for the stacking.

(3) The positioning stops for the stacking are equidistant, synchronous and raised simultaneously with each step of the first belt.

(4) Positioning stops are provided for the stops in line with the press or the device for loading raw products acting in synchronism with the latter, and likewise operating by sliding of the belt.

(5) The advancement step of the first belt is equal to or little more than the gap between supports at the station for loading the supports on the said belt, multiplied by the number of raw products which are deposited simultaneously by the press (or the loading device).

(6) The means of repositioning to the initial spacing are constituted by at least one battery of equidistant, synchronous and simultaneous stops, disposed along the third belt, these batteries being placed at points that divide into equal parts the space between the axis of the unstacking station and the axis of the station for collection for storage and transfer, and the advancement step of the third belt is equal to or little more than the gap between the unstacking station and the nearest battery of stops.

(7) The system of transfer of empty supports incorporates a battery of pincers equipped with means permitting the turning of the supports on a horizontal axis.

(8) The system of transfer and storage of the empty supports comprises two independent batteries of pincers, one for picking up supports on the third belt and depositing them on a conveyor, the other for picking them upon the conveyor and loading on the first belt.

(9) In a first variation according to (8), the second of these two batteries also places supports on a storage area and picks them up.

(10) In a second variation according to (8), the storage area is constituted by carriages travelling between the unstacking and stacking stations and constituting transfer conveyors, the empty supports picked up on the third belt being returned to the carriages by a first supplementary belt attached to the unstacking station, then picked up on these carriage and sent back to loading by a second supplementary belt attached to the stacking station.

(11) Between the unstacking and stacking stations there is a track and/or side tracking means for the carriages.

(12) The batteries of pincers of the stacking station are twinned, equidistant and their gap is one half the gap between the second belt and the third belt.

The invention will be more amply described with reference to the attached drawing schematizing a preferred example of embodiment of an installation according to the invention.

Figures 1, 2:
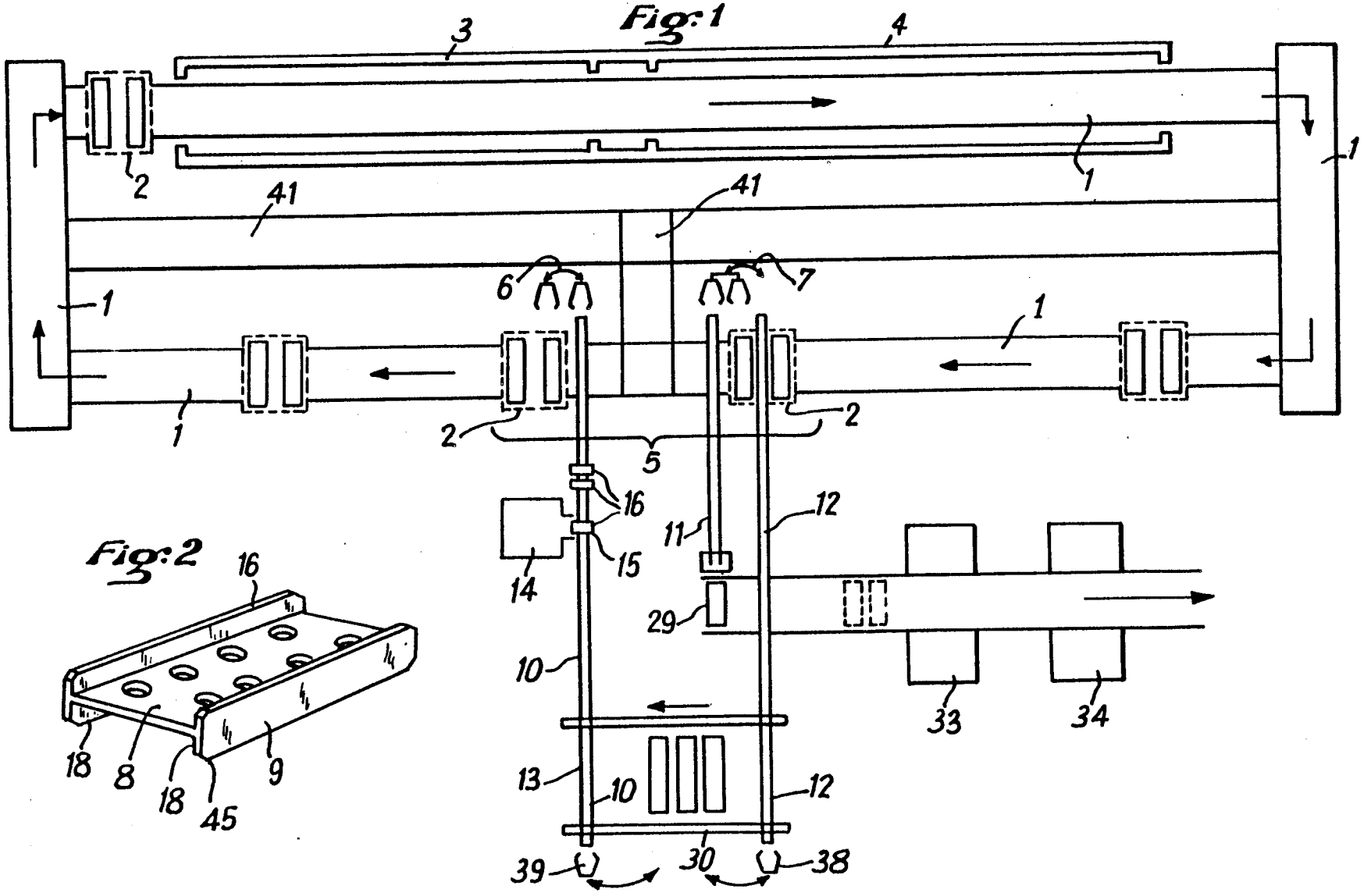
FIG. 1 is an overall sketch in plan view of the installation.
FIG. 2 shows in perspective, an example of a ceramic support which is to be handled.

Referring to FIG. 1, it can be seen that the installation comprises a track or route 1 on which carriages 2 move in a closed circuit passing through the drying furnace 3 and the baking furnace 4 and return to furnace 3 through a zone 5 comprising, successively, a station 7 where the backed products are picked up and the supports unstacked, and a station 6 where the supports are stacked.

This plan is designed to meet the handling needs of an installation in which the raw and green products are placed, after molding, on ceramic supports (or supports of other refractory material) capable of responding both to the conditions of drying in furnace 3 and baking in furnace 4, for example a support of the type represented in FIG. 2, comprising a perforated sole 8 on which the raw product or products are deposited without contact between each other, and side walls 9 for stacking without contact of the products with adjoining supports, and able to take the load on stacking.

An installation meeting these characteristics is described in French Pat. No. 85.10712 filed on July 12, 1985 in the name of the Societe d'Etudes et de Constructions Electriques et Mechaniques SECEM; it permits a reduction of the drying time and baking times, eliminates any intermediate handling between the drying furnace and baking furnace, but is requires the creation of a system of handling capable of embodying the emplacement of raw and green products on the supports, the stacking of the latter with a very dense and very strict positioning, then the removal of the baked products and their packaging as well as the return of the supports with a modification of their relative positioning.

To meet these conditions, the installation of the invention combines, with the circuit of carriages 1, three conveyor devices which can, as in the example represented, be belt conveyors or endless chain conveyors 10, 11, 12 which are disposed transversely.

Figure 3:
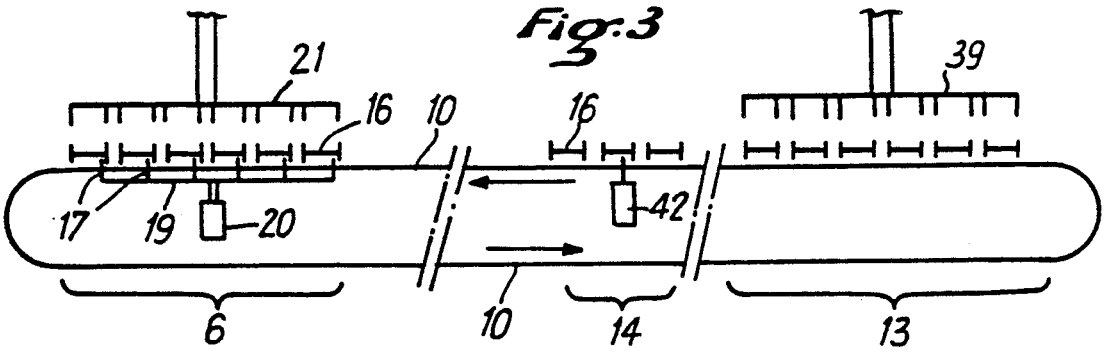
FIG. 3 illustrates, in schematic elevation, the route and the functions of the first endless belt.

The first belt 10 runs from a station 13 for loading empty supports to the stacking station 6, passing before a station 14 for loading raw and green products on the supports (FIGS. 1 and 3).

Station 14 will be, for example, a press that shapes one or more products and deposits them at 15 on a support 16 (or a plurality of supports) borne by belt 10 as these supports pass before press 14. This station 14 can also be an extruder or system of loading products shaped by separate means. A means of positioning of supports 16, such as stop 42 raised synchronously with press 14 is provided to insure the positioning of the raw products on these supports. Belt 10 is animated with a stepwise movement whose pitch is equal to or slightly greater than the gap between the supports at loading point 13 when press 14 is feeding only one support at a time. If n supports are fed simultaneously at 14, the advancement step of belt 10 will be equal to or slightly longer than n times the gap between supports at 13.

In order to optimize the performances, a detection device is advantageously provided to prevent the advancement of support 16 in cases where, for any reason, device 14 has not delivered a product.

At loading station 13 the supports are relatively spaced (a few centimeters, for example 4 to 5 centimeters approximately); this arrangement is preferably reduced to a few millimeters at stacking station 6 (for example 10 to 12 mm) in order to make optimum use of the volume of the furnace and to force the circulation of air through the supports. With this in mind, the invention provides the use of equidistant mobile stops 17, retractable under the plane of belt 10 and cooperating, when they are raised, with the internal faces 18 of flanges 9 of the supports. In the example represented, these stops 17 are linked at 19 in a unit battery whose movements are commanded by jack 20 with each forward step of belt 10. As the supports 16 advance in station 6, they are therefore brought into the equidistance provided for the stacking, which is the equidistance between stops.

When a complete series of supports 16 has arrived at 6, all of the supports in this series are picked up by a battery of pincers 21, which are disposed to act on the supports without coming in contact with the products (for example to act on the bases 45 of the side walls 9, shaped for this purpose).

Figure 5:
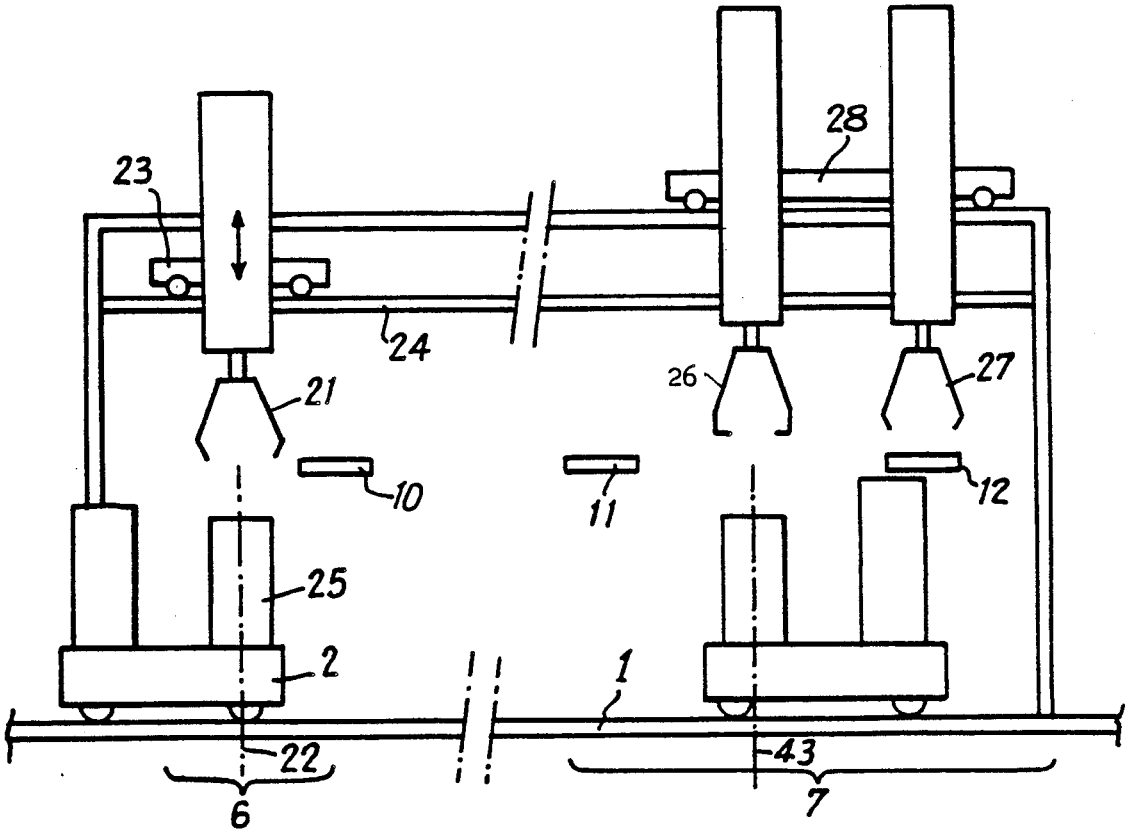
FIG. 5 illustrates, in schematic elevation, the first and second battery of pincers.

As represented in FIG. 5, battery 21 is movably mounted vertically and parallel to track 1 between a position above belt 10 and position above stacking point 22. For example, battery 21 is movably mounted vertically on a carriage 23 running on gantry 24.

By these means the supports 16 are thus deposited in a stack 25 on a carriage 2 with a minimum spacing and a strictly controlled positioning which permits stacking a large number of supports with no risk of accidents.

After the drying and baking, the carriages 2 reach station 7 where, on the one hand the baked products are picked up and on the other hand the empty supports are unstacked by means of the double battery of pincers 26, 27, animated with movements analogous to those of battery 24.

As represented in FIG. 5, the two batteries 26 and 27 are advantageously borne by a single carriage 28 and the gap between them is one half the gap between the second and third belt 11 and 12.

The pincer 5 of battery 26 are disposed to cooperate with the baked products while the pincers of battery 27 are disposed to cooperate with supports 16.

To pick up certain products of complex shape, a negative-pressure grasping system may be preferred over pincers 26, such as a suction-cup or any other equivalent system. In this respect, the term "pincer" in the present specification, designates any means for grasping the products or supports.

The second belt 11 runs from station 7 to a station 29 and provides the pickup of the baked products, while the third belt 12 runs from station 7 to the transfer station 30.

With carriage 28 in the position represented in FIG. 5, battery 26 descends and picks up a series of baked products, then rises again, carriage 28 moves to the left and battery 26 deposits baked products 44 on belt 11 (FIG. 7), while battery 27 picks up the empty supports at position 43. Then with the batteries raised, carriage 28 moves to the right and battery 27 deposits the empty supports on belt 12, while battery 26 picks up a fresh series of baked products.

Figure 8:
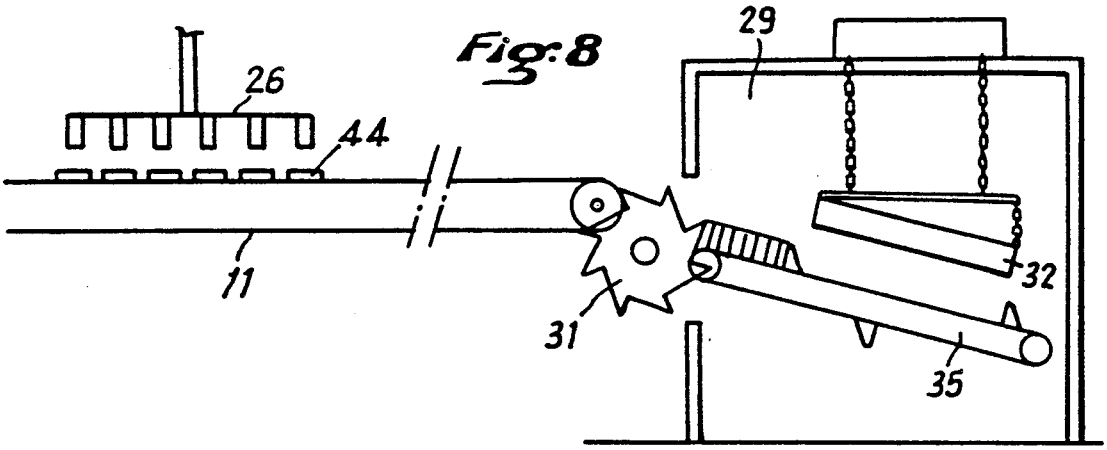
FIG. 8 illustrates, in schematic elevation, the second endless belt.

Belt 11 brings the baked products toward station 29 as schematized in FIG. 8. The characteristics of this station are not part of the invention. It can be embodied by means of a rocking lever 31 of known type, straightening the tiles against one another on a belt 35 for collective pickup by a pincer 32 which brings them to strapping and palletizing stations etc. 33, 34, etc. (FIG. 1). It is also possible to use the means of French Pat. No. 80.08,157 filed on Apr. 11, 1980 in the name of the Societe Centre d'Etudes et de Realisations Industrielles et Commerciales, published under No. 2,480,253.

Figure 4:
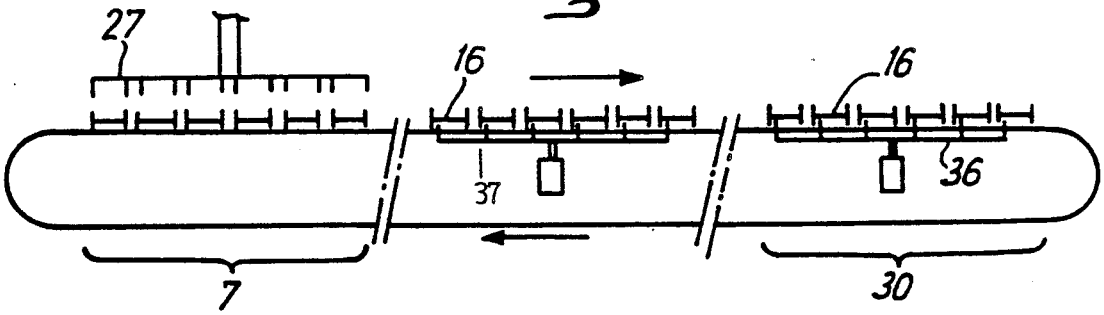
FIG. 4 illustrates, in schematic elevation, the route and functions of the third endless belt.

Belt 12 takes the empty supports toward the system of storage and transfer 30 (FIG. 1, FIG. 4). During this displacement, supports 16 are separated by at least one battery of stops 36 situated in line with station 30. A plurality of batteries 36, 37 can be judged preferably or made necessary if the separation to be made is relatively large. In this case batteries 36, 37 are placed so as to divide into equal parts the distance separating the axis of station 7 from the axis of station 30 and the length of the advancement step of belt 12 is equal to or little greater than one of these equal parts.

This spreading operation returns supports 16 to the initial interval for loading on belt 10. Furthermore it permits or facilitates the replacement of damaged supports by fresh supports.

The storage and transfer system 30 can be embodied in various ways.

Figure 6:
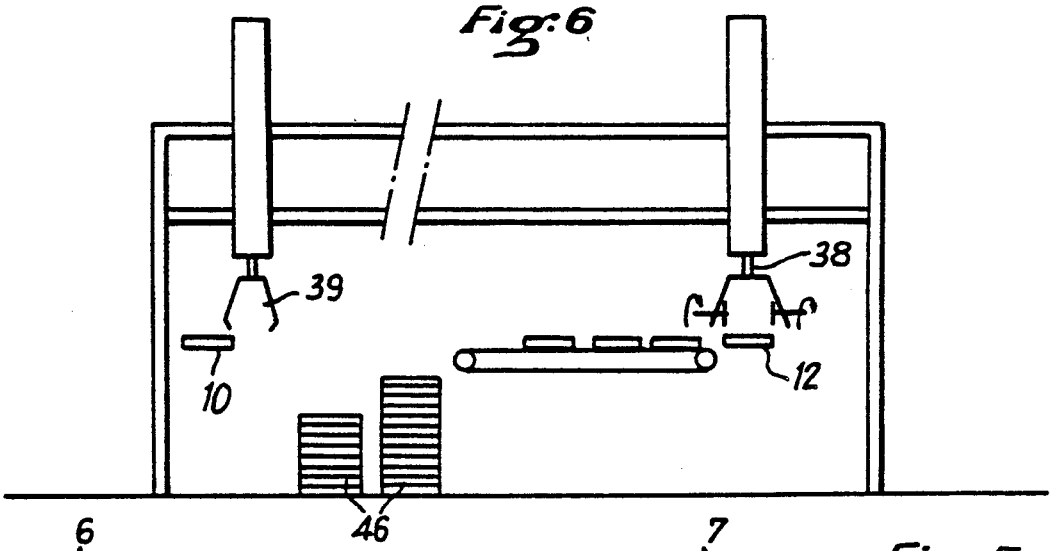
FIG. 6 illustrates, in schematic elevation, a fist variation of a system of storage and transfer.

In the variation in FIG. 6, there are two batteries of pincers 38 and 39, the first picking up the supports on belt 12 and depositing them on a conveyor 40, and the second taking them for loading at 13 on belt 10 or, alternately, to pick them up on conveyor 40 and store them at 46.

Preferably, once more, battery 38 is mounted rotatably on a horizontal axis to permit the turning of the supports for example for cleaning, or to cancel out any accumulations of deformations resulting from creep after each passage in the furnace that can lower the longevity of the supports.

Figure 7:
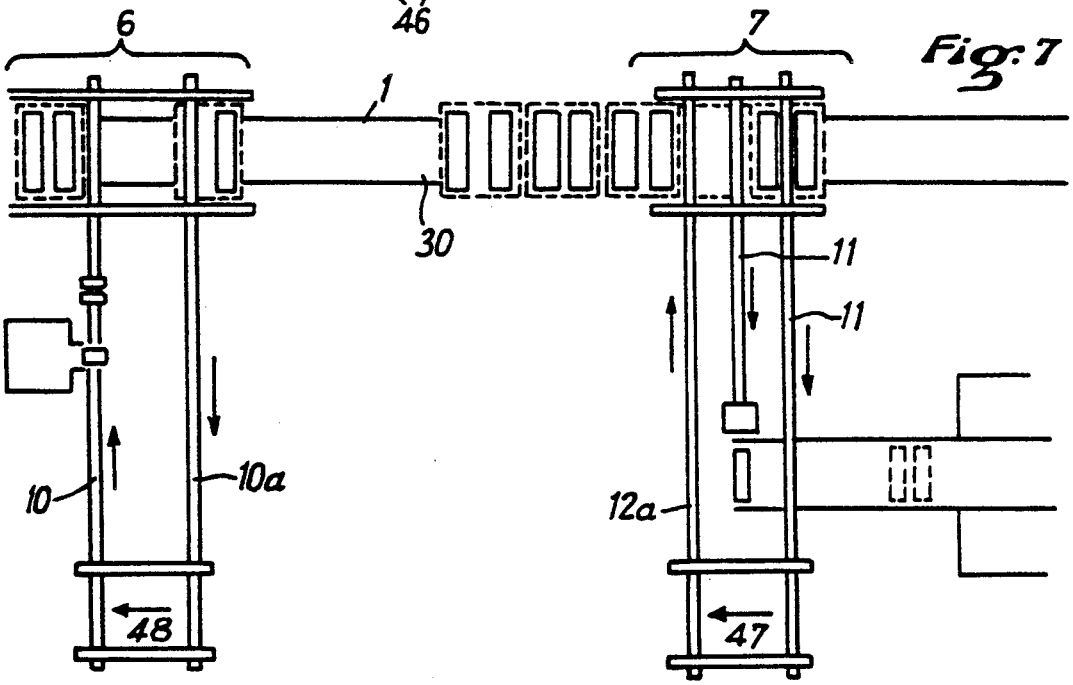
FIG. 7 illustrates, from above, a second variation of the system of storage and transfer.

In the variation of FIG. 7, the empty supports are transferred at 47 from belt 12 to a complementary and attached belt **12*a* that returns them to station 7 where they are stacked on the carriages 2 and at station 6 there is a complementary and attached belt 10*a* on which the empty supports are loaded to be transferred at 48 onto belt 10. In this case the stations 6, 7 are separated by a sufficient distance to enable carriages 2, between these two stations, to serve the double role of conveyors and storage area 30*a*. The means of transfer at 47 and 48, as well as between belts 12*a*, 10*a*. and carriage 2** can be batteries of pincers (or suction cups) analogous to those already described.

Another arrangement of the invention consists in the fact that stations 6 and 7 are spaced by a length greater than that of a carriage and there is a side track 41 between stations 6 and 7 in particular to permit the removal of a carriage for repairs or to introduce a fresh or additional carriage. The interval between stations 6 and 7 is, actually, the only place on track 1 where the carriages are empty.

In the variation of FIG. 7, carriages 2 are loaded with empty supports between stations 6 and 7. But they are empty between belts 11 and **12*a* or between belts 10*a* and 10**. It is therefore possible to place a side track at these points by providing, between belts, a spacing greater than the length of a carriage.

The invention can be applied with various means, those described above not being of a limiting nature.

Thus, for example, the belts 10, 11, 12 can be replaced by chain systems which permit the use of positioning means different from the stops that produce a sliding.

As a matter of fact, the chains have a precision of mechanical advancement and it is possible to vary and regulate the spacings by transfers from one chain to another.

The mechanical details of the pincers and of their operation has not been described because it involves a technology known to the specialist in the art. It is, for example, equivalent to use pincers with mechanical grasp or batteries of arms bearing suction cups.

I claim:

1. Installation for handling ceramic products of the type incorporating a track for carriages including a closed circuit passing through at least one of a drying furnace and a baking furnace and crossing a zone comprising a station for picking up baked products and unstacking their supports, followed by a station for stacking supports with raw or green products, comprising:

a first conveyor transverse to said track on which are placed empty supports which are then loaded with raw products as the empty supports pass before a loading station and which terminates at a stacking station for stacking the supports loaded with raw products on a carriage which is on said track, a second conveyor, likewise transverse to said track, running side by side with the first conveyor and in the opposite direction to the first conveyor, from an unstacking station for picking up on supports the baked products to a station for picking up these baked products for packaging, a third conveyor placed beside the second conveyor, running from said unstacking station where the empty supports are unstacked to a conveyor for transfer of said supports, a first set of grasping means designed for raw products, which moves vertically and parallel to said track between a position situated above the first conveyor and a position above a carriage located on the track in stacking position at said stacking station, a second set of grasping means designed for baked products, which moves vertically and parallel to said track between the second and third conveyors, stepwise drive means for the various conveyors linked with the operations of loading supports, loading raw products, stacking supports loaded with raw products, picking up baked products, unstacking empty supports, and storing and transferring empty supports.

2. Installation according to claim 1 in which the first set of grasping means is constituted by a battery of pincers (21) seizing the supports (16) loaded with raw products to deposit them on carriage (2) waiting on track (1) at stacking point (22).

3. Installation according to claim 2 in which means (17, 19) are provided to insure the strict positioning of the loaded supports before seizure by the first battery (21), these means providing a controlled closing up of the said loaded supports.

4. Installation according to claim 3, in which the second set of grasping means incorporates a battery of pincers (26) handling the baked products and a battery of pincers (27) handling the supports (16) when empty, this set (26, 27) moving parallel to track (1) between the second and third conveyors (11 and 12) with stops above an intermediate point (43) for picking up baked products and unstacking supports.

5. Installation according to claim 4 in which means (36, 37) are provided to position the supports (16) prior to their transfer and storage, providing for a relative separation of the said supports.

6. Installation according to claim 3, characterized in that the strict positioning of the supports (16) is provided by means of stops (17), mobile and retractable under the first conveyor, these stops cooperating with the internal faces (18) of lateral bottom flanges (9) borne by said supports (16) so as to cause the latter to stop while the first conveyor continues to advance.

7. Installation according to claim 6, characterized in that the spacing between the supports (16) on the transverse conveyors (10, 11, 12) is variable so as to be several millimeters in the zones where the said supports (16) are loaded and unloaded and several centimeters in the remaining zones of the said conveyors.

8. Installation according to claim 6, characterized in that the positioning stops for the supports are equidistant, synchronous and raised simultaneously with each step of the first conveyor.

9. Installation according to claim 8, wherein the stacking station includes a press that shapes the raw and green products and deposits them on the supports, and positioning stops are provided for the supports in line with the press which act in synchronism with the press.

10. Installation according to claim 1, characterized in that the stacking station includes a press that shapes the raw and green products and deposits them on the supports, and an advancement step of the first conveyor is equal to or little more than the gap between the supports at the stacking station multiplied by the number of raw products which are deposited simultaneously by the press.

11. Installation according to claim 1, wherein a means of repositioning the supports to an initial spacing includes at least one battery of equidistant, synchronous and simultaneous stops disposed along the third conveyor, these batteries being placed at points dividing into equal parts the space between the axis of the unstacking station and the axis of the transfer conveyor, and an advancement step of the third conveyor is equal to or little longer than the gap between the unstacking station and the nearest battery of stops.

12. Installation according to claim 1, characterized in that a battery of pincers (38) is equipped with means for turning the support about a horizontal axis.

13. Installation according to claim 1, further comprising two independent batteries of pincers, one for picking up the supports on the third conveyor and depositing them on the transfer conveyor, the other for picking them up from the transfer conveyor and loading them on the first conveyor.

14. Installation according to claim 13, characterized in that one of these two batteries also places the supports on a storage area for the supports and picks them up therefrom.

15. Installation according to claim 14, characterized in that the storage area is constituted by carriages travelling between the unstacking and stacking stations and constituting transfer conveyors, the empty supports transported on the third conveyor being returned to the carriages by a first supplementary belt attached to the unstacking station to be transferred to these carriages and returned to the stocking station by a second supplementary belt attached to the stacking station.

16. Installation according to claim 1, characterized in that between the unstacking (7) and stacking (6) stations, there is a means (41) for side-tracking the carriages (2).

17. Installation according to claim 1, characterized in that the second set of grasping means (26 and 27) of the unstacking station are twinned, equidistant, and the gap between them is half of the gap between the second conveyor (11) and the third conveyor (12).

* * * * *